United States Patent [19]

Palmer et al.

[11] 4,112,401

[45] Sep. 5, 1978

[54] ELECTRICAL SWITCHING APPARATUS AND CONTROL SYSTEM FOR USE THEREWITH

[75] Inventors: James E. Palmer, Moorestown; Donald C. Lavallee, Haddon Heights; George Huber, Mt. Laurel, all of N.J.

[73] Assignee: Spectron Corporation, Mt. Laurel, N.J.

[21] Appl. No.: 777,117

[22] Filed: Mar. 14, 1977

[51] Int. Cl.[2] ..... H01H 36/00

[52] U.S. Cl. ..... 335/206

[58] Field of Search ..... 335/112, 152, 205, 206, 335/207; 340/365 L, 365 S

[56] References Cited

U.S. PATENT DOCUMENTS

| | | | |
|---|---|---|---|
| 3,210,498 | 10/1965 | Jackson et al. | 335/207 X |
| 3,249,715 | 5/1966 | Warman | 335/206 X |
| 3,337,825 | 8/1967 | Brooks | 335/206 X |
| 3,419,710 | 12/1968 | Mathews, Jr. et al. | 335/206 X |
| 3,506,939 | 4/1970 | Hesser | 335/206 |
| 3,514,729 | 5/1970 | Webb | 335/207 |
| 3,581,030 | 5/1971 | Sedley | 335/206 X |

*Primary Examiner*—R. N. Envall, Jr.
*Attorney, Agent, or Firm*—Howson and Howson

[57] ABSTRACT

An array of magnetically-actuatable electrical switches is controlledly operated in response to changes in position of a movable member controlling the magnetic field reaching the switching elements. The movable member may for example comprise a panel, supporting permanent magnets which are moved into switch-closing or switch-opening positions by motion of the panel, or a movable magnetic shielding arrangement used in conjunction with fixed permanent magnets so that the position of the magnetic shield determines whether the switches are open or closed. The preferred arrangement is such that the motion of the movable switch-controlling member can be accomplished mechanically by a manually-operable actuator or electrically by an electrically-controlled solenoid arrangement, at the option of the operator. In one preferred embodiment a latching arrangement is provided which holds the movable switch-controlling member in one of two stable positions until either the manually-operable mechanical actuator or the electrically-controlled solenoid is momentarily operated to move the movable member to its opposite stable position. In other cases, the switch-controlling movable member may, in effect, latch itself in that it maintains whatever position it is placed in, due to its own inertia and associated friction, until it is forced into an alternate position. In still other embodiments the movable switch-controlling member may be spring-biased to one of its two operative positions, so that it is held in its alternate operative position only while displacing force due to the mechanical actuator or the solenoid device continues to be applied thereto. The apparatus not only makes possible the desired electrical control of switching, either from a local position or from a more remote position such as a central control site, but also enables local mechanical control of switching in the event that power outage or other malfunction prevents the electrical control from functioning properly, or for other reasons.

19 Claims, 10 Drawing Figures

ELECTRICAL SWITCHING APPARATUS AND CONTROL SYSTEM FOR USE THEREWITH

BACKGROUND OF THE INVENTION

There are many applications in which controlled switching of a large plurality of electrical conductors, e.g. 24 or more conductors, is desired or necessary. In many such switching applications, particularly those involved in data communications where rearrangement of communications facilities is to be accomplished by electrical switch means, it is often desirable to provide for remote operation of the switch means, and/or to provide rather complex sets of operations of various switch means from a single location. Either of these operations can be accomplished by means of separate electrical controls for each switch means, but at the cost of great complexity in control equipment. It is also desirable to provide for straightforward mechanical actuation of the switch means; this is desirable, for example, to accommodate failure of the electrical control system due to power outage or other malfunction which prevents the electrical control system from operating properly. Mechanical control of the switching means may also be a convenience in cases where the electrical control is at a remote site and the operator wishes to activate the switching means from his position immediately adjacent the switching apparatus, rather than from the remote control position. The desired mechanical operation of a large number of switches can be provided conventionally by using a corresponding large number of switch actuators such as switch buttons, with attendant complexity. However, so far as is known there has been no apparatus available which would provide simple and inexpensive switching of lines containing a large number of conductors, by electrical control or by manual control at the option of the operator.

While there are a large variety of instances in which such apparatus will have application, for simplicity and clarity of exposition the present invention will be described particularly with respect to the following specific application thereof.

In our co-pending application Ser. No. 656,597 entitled "Connecting And Switching Systems, And Switching Apparatus Suitable For Use Therein", filed Feb. 9, 1976 and now U.S. Pat. No. 4,037,186, issued July 19, 1977, there is shown a system wherein a modem is connected to local equipment, such as a computer, by way of a line comprising a plurality of conductors extending through a corresponding plurality of magnetically-operable switches. The multi-conductor line also extends from at least one side of the switching element to multi-contact plug receptacles into which the plug of a patchcord can be inserted to transfer the signals on the multi-conductor lines to any other desired position. The arrangement in the cited patent application is such that, in response to insertion of the plug into the receptacle, the switches normally connecting the modem to the local equipment are automatically opened, for purposes and reasons fully set forth in that patent application, the switches reclosing automatically when the plug is removed. This is accomplished by causing the inserted plug to change the position of a panel which changes the magnetic flux reaching a set of magnetically-operable reed switches.

In some cases, to which the present invention is applicable, one may desire or require the capability of switching the multi-conductor line extending to the local equipment to another, substitute local equipment. For example, where the local equipment is a main computer it may be desirable, in the event of breakdown, malfunction or routine maintenance of the main computer, to substitute a back-up computer for it, at least temporarily. This capability may be provided by inserting a first multi-conductor switch arrangement in the line to the main computer and a second multi-conductor switch arrangement in the line to the back-up computer, and providing switch control means which will open the line to the main computer and close the line to the back-up computer when substitution of the back-up computer is desired, and vice versa.

In such cases, it may be desirable to be able to operate a device which will act electrically to substitute the back-up computer in the connection to the above-mentioned modem, and it may in fact be desirable to switch one or more other modems to the back-up computer by electrical means. Further, in the event of breakdown of the electrical control system it would be advantageous to be able to accomplish this substitution of the back-up computer by mechanical means not dependent upon the existence of electrical supply power.

While the relatively-simple application with respect to which the present invention will be particularly shown and described has been selected for simplicity of description and is rather rudimentary in its overall functions, it will be understood that the invention may be applied to extremely complex control systems of a large variety of types and classes, as will occur to one skilled in the art upon a reading of this specification.

Accordingly, it is an object of this invention to provide new and useful apparatus for electrically controlling the switching of plural-conductor electrical lines.

Another object is to provide such switching in response to an electrical control signal, in a manner which is particularly simple and reliable.

A further object is to provide simple mechanical control of said switching in addition to said electrical control, also in a manner which is relatively simple and reliable.

Still another object is to provide such a system in which either mechanical or electrical control of multi-conductor lines may be exerted by an operator, at his option, and in which the mechanical arrangement will still be fully operative if the electrical control arrangements should become inoperative or disconnected.

BRIEF SUMMARY OF THE INVENTION

In its preferred form, these and other features of the invention are accomplished by providing magnetically-actuatable switch means, magnet means positioned adjacent the switch means, and electrically-controllable electromechanical means for controlling the effect of the magnet means upon the switch means to accomplish controlled operation of the switch means from a first electrical state thereof to a second electrical state thereof. Preferably this is accomplished by utilizing magnetically-operable switches for the switch means, together with movable means for controlling operation of said switch means and comprising, for example, either means for moving one or more permanent magnets with respect to the switch means, means for moving the switch means with respect to the magnet or magnets, or means for moving a magnet shielding arrangement interposed between the magnet means and the switch means; the electrically-operable electromechanical means, which may comprise a solenoid device, is then preferably utilized to control the positioning of the movable means to effect the desired control of the states of the switch means.

Preferably the foregoing arrangement is utilized in combination with manually-operable mechanical means for also controlling the operation of the switch means, preferably by acting upon the same movable means as does the electromechanical means although this is unnecessary in itself. Preferably the mechanical means for controlling the switches is in the form of a pushbutton or the like available at the front of the equipment, which need merely be manually pressed or otherwise moved to accomplish the desired switch operation. In a preferred form, the switch control arrangement is provided with a latching system which causes it to move to, and remain at, one of two stable switch-controlling positions in response to either the electrical control or the mechanical control, and to return to the other stable switch-controlling position only upon the subsequent operation of either the mechanical control or the electrical control. Thus, when both types of controls are operating properly, either may be utilized to operate the switch means to either desired state thereof, and if the electrical control means is inoperable for any reason, the mechanical means can be used as a backup under such conditions.

BRIEF DESCRIPTION OF FIGURES

These and other objects and features of the invention will be more readily understood from a consideration of the following description, taken in conjunction with the accompanying figures, in which.

DETAILED DESCRIPTION OF SPECIFIC EMBODIMENTS

Figure 1:
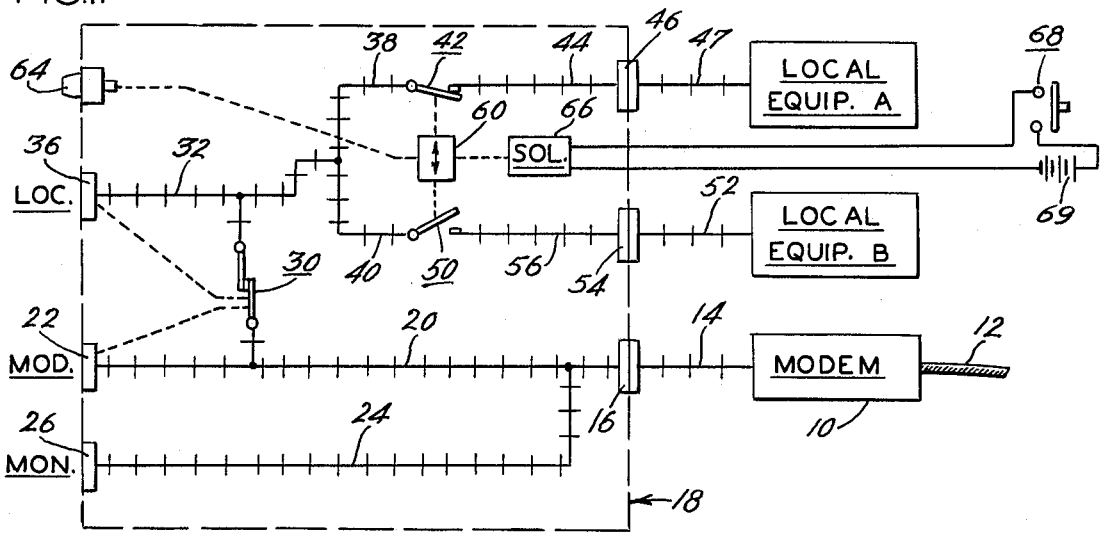
FIG. 1 is a schematic diagram of one system to which the invention is applicable.

Without thereby in any way limiting the scope thereof, the invention will be now described with particular reference to use in the type of system illustrated schematically in FIG. 1.

In this system it is assumed that a conventional modem 10 is connected to an appropriate external two-wire communication line 12, to and/or from which information signals are to be conveyed by the modem. A multi-conductor line 14 from the modem is connected to a multi-contact plug-receptacle device 16 on a module 18; line 14 may, for example, include 24 mutually-insulated wires plus a ground wire. Within the module 18, the multi-conductor line 14 extends over corresponding multi-conductor line 20 to a front receptacle 22 of module 18. A multi-conductor branch line 24 also extends from plug-receptacle device 16, to another front receptacle 26. Multi-conductor line 20 is also connected through multi-element switch means 30 to another multi-conductor line 32, the switch means 30 including one switch for each of the conductors of lines 20 and 32.

Switch 30 is normally closed, so that line 20 is normally connected to line 32. Line 32 extends in one direction to a front receptacle 36, and in the other direction to a pair of branch multi-conductor lines 38 and 40. Line 38 extends through multi-conductor switch means 42, containing one switch element for each of the conductors in the line, to a corresponding multi-conductor line 44, which leads to plug-receptacle device 46 on module 18. Plug-receptacle device 46 is connected through a corresponding multi-conductor line 47 to local equipment A, which may for example be a local computer.

Switch means 42 being normally closed, the portion of the system thus far described is the same overall arrangement as is described in our above-cited co-pending application Ser. No. 656,597. Thus, modem 10 normally is in communication with local equipment A and with all three of the receptacles 22, 26 and 36 on the front of module 18; however, at least receptacles 22 and 36 are the type described in co-pending application Ser. No. 656,597, in which insertion of a patch-cord plug into either of the receptacles operates mechanically to open the switches of switch means 30, whereby lines 20 and 32 are isolated from each other so long as the plug is in position in the receptacle. A patch-cord plug inserted into receptacle 26 will always display the signal from modem 10, regardless of the condition of switch 30; insertion of a patch-cord plug with actuating prong into receptacle 22 will connect receptacle 22 to modem 10 while isolating it from local equipment A; and insertion of a patchcord plug with actuating prong into receptacle 36 will connect receptacle 36 to local equipment A, in isolation from the modem. The purposes and advantages of such an arrangement are fully described in our above-mentioned co-pending application and need not be repeated here.

The portion of FIG. 1 related to the present invention involves apparatus for controlledly connecting local equipment B to line 32 in place of local equipment A, thus functionally substituting local equipment B for local equipment A, as may be desired for example when local equipment A breaks down or requires routine service. In general, this is accomplished by opening the switch means 42 to isolate local equipment A, and closing corresponding switch means 50 at about the same time so as to connect local equipment B over external multi-conductor line 52, plug-receptacle device 54 and mutli-conductor line 56 to line 32 and front receptacle 36 as desired.

In general, this desired operation of switches 42 and 50 is accomplished by a movable mechanical member 60, the position of which determines whether switch means 42 or switch means 50 is closed. Preferably, as illustrated schematically in FIG. 1, movable mechanical member 60 can be moved to its alternate position for which switch means 42 opens and switch means 50 closed, either by manual operation of mechanical control device 64, such as a pushbutton mechanically linked to member 60, or alternatively by an electrical control device 66 in the form of a solenoid device the armature of which is mechanically linked to member 60 and operable in response to closing of the contacts of a remote, manually-operable electrical switch 68, which is connected in series with a current source 69 and the solenoid winding. Switch 68 may be located in any convenient position, which is highly advantageous, and while mechanical control device 64 may also be placed in any of a variety of positions it is advantageously placed on the front panel of module 18.

Figure 2:
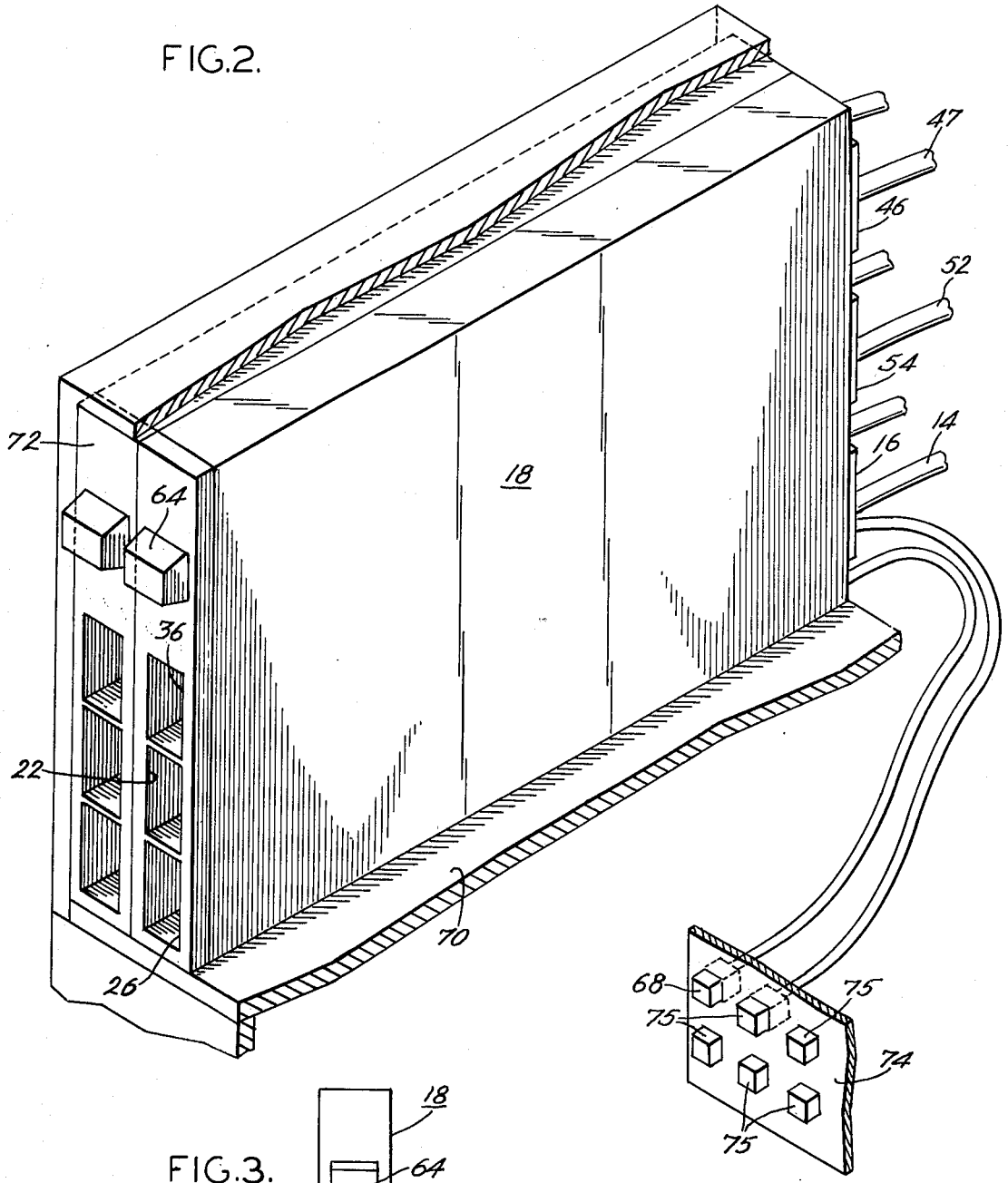
FIG. 2 is a perspective view, partly broken away, showing the exterior of one embodiment of the invention.
Figure 3:
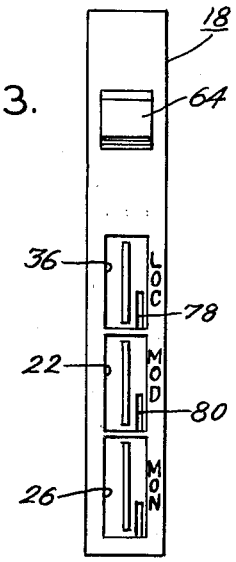
FIG. 3 is a front view of the front of one of the modules of FIG. 2.

Referring now to FIGS. 2 and 3 showing the exterior appearance and arrangement of a typical system according to FIG. 1 and embodying the present invention, and in which parts corresponding to those in FIG. 1 are designated by corresponding numerals, the module 18 is supported on a platform or cabinet 70 in an array of similar modules, of which adjacent module 72 is typical. The assembly of such modules provides a common type of communications control center typically used in switching and analyzing defects in communications systems. The mechanical control device 64 in the form of a pushbutton is in this case mounted on the front surface of the module for convenient access and use, while the electrical control device 68 in the form of an electrical switch is mounted on a panel 74 along with other similar switches such as 75 controlling the switching within other modules of the system; the panel 74 and its switches may if desired be located at a convenient control desk, or on an appropriate control panel, remote from the module array. The slots 78 and 80 in receptacles 36 and 22 (see FIG. 3) accommodate the actuating prong of the patch-cord plugs, as shown and described in our above-cited co-pending application.

Referring now particularly to FIGS. 4–7 showing one preferred embodiment of the apparatus to be contained within the module 18, the general arrangement is one in which each of the arrays of switching elements comprising switch means 42 and 50 are made up of magnetically-operable reed switches and positioned in confronting relation to a corresponding pair of permanent magnet members; a slidable arrangement of magnetic shields is positioned between the permanent magnets and the switch arrays and controlledly moved so that in one position thereof one of the switch arrays is shielded and the other is not, while in another position thereof the opposite condition of shielding exists, whereby the two arrays may be switched to their alternate states by appropriate motion of the slidable shield means.

More particularly, module 18 comprises a main support panel 80 at the rear of which are mounted the plug-receptacle devices 16, 54 and 46, and on the front of which are mounted the mechanical control device 64 and the plug receptacles 22, 26 and 36. The various multi-conductor lines within the module are in the form of printed-circuit conductors on the main support panel, such as conductors 44, 56 and 20, shown fragmentarily; in the interest of clarity the remainder of such printed-circuit conductors have not been shown, since the interconnections to be provided are apparent from the schematic drawing of FIG. 1, it being sufficient to note that each of the printed-circuit conductors extends, and is connected, to its appropriate corresponding switch element or other conductor according to the arrangement of FIG. 1.

In this example the switch means 30 comprises two arrays of individual magnetically-actuatable reed switch devices such as 82, switch means 42 comprises the vertical array of magnetically-actuatable reed switch elements such as 83, and switch means 50 comprises the vertical array of magnetically-actuatable reed switches such as 84. The individual reed switches are appropriately mounted on the main support panel 80 and are understood to be appropriately connected to their corresponding printed-circuit conductors.

Also provided in this embodiment are two movable members in the form of a slidable panel 86 and a slidable panel 88. Panel 86 is longitudinally slidable in tracks 90 and 92 between its position shown in full line and its position shown in broken line, while panel 88 is longitudinally slidable in tracks 94 and 96 between its full-line and broken-line positions.

Panel 86 supports a pair of permanent magnets 96 and 98, and is spring-biased to a forward position by coil spring 100. As shown, the permanent magnets 96 and 98 are aligned with the corresponding array of switching elements to hold them normally closed; when a patch-cord plug carrying an actuator prong is inserted into either of receptacles 22 or 36, it moves panel 86 to the right in the drawing so that the magnets move out of alignment with their corresponding switches, and the switches then return to their spring-biased open positions thus opening switch means 30. The details of construction and operation of this portion of the module contents will not be further discussed, since, as pointed out above, it may be identical with that described and shown in our above-cited co-pending application.

Slidable panel 88 is mounted between the switch arrays 42 and 50 on the one hand, and a fixed panel 106 supporting a pair of rectangular permanent magnets 108 and 110 aligned, respectively, with switch arrays 50 and 42. Slidable panel 88 carries on it magnetic shielding members which, in this example, are in the form of vertical strips 112 and 114 of a magnetic material such as steel, which may be cemented to the panel 88; panel 88 may, for example, be of epoxy glass or other plastic material, and, in any event, in itself has no significant magnetic shielding effect. However, each of the shielding strips 112 and 114 is sufficiently thick that, when aligned directly between one of the permanent magnets and the corresponding array of magnetically-actuatable reed switches, it prevents magnetic actuation of the reed switches aligned therewith by the corresponding magnet.

Figure 5:
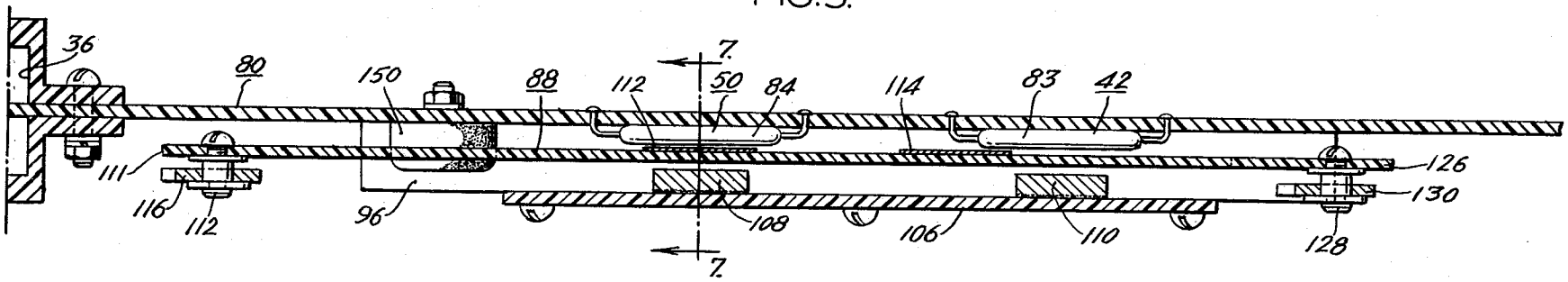
FIGS. 5 and 6 are sectional views taken along lines 5—5 of FIG. 4, showing the apparatus in its two opposite stable switching positions.

Thus, for example, in FIG. 5 the magnetic shielding element 112 is shown aligned with the reed switches of switch means 50 and with permanent magnet 108, so as to shield the reed switches from the effects of the magnetic field of permanent magnet 108, thus permitting the reed switches to assume their normally-open condition; on the other hand, magnetic shield member 114 is misaligned with its corresponding switch means 42, so that the magnetic field from permanent magnet 110 reaches the reed switches of switch means 42 and holds them in their closed conditions for the position of the panel 88 shown in FIG. 5.

Figure 6:
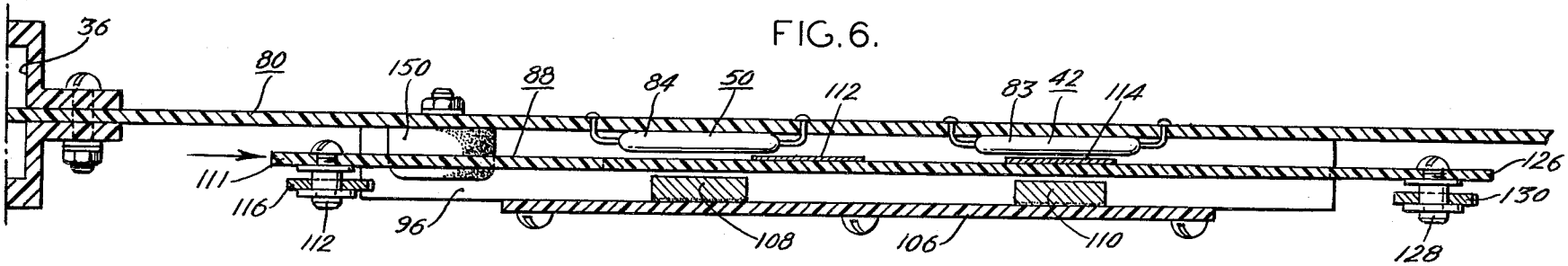
Figure 7:
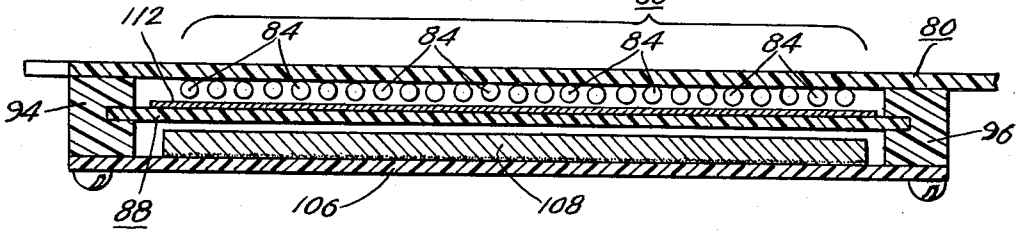
FIG. 7 is a sectional view taken along lines 7—7 of FIG. 5, rotated by 90° for convenience of drawing.

However, when the panel 88 is shifted to the position shown in FIG. 6, magnetic shield 112 is moved out of alignment with its switch means 50, while magnetic shield means 114 is moved into alignment with its switch means 42. The result is that the motion of the panel member 88 from the position shown in FIG. 5 to that shown in FIG. 6 causes switch means 50 to close and switch means 42 to open, as is desired when local equipment B of FIG. 1 is to be substituted for local equipment A.

Figure 4:
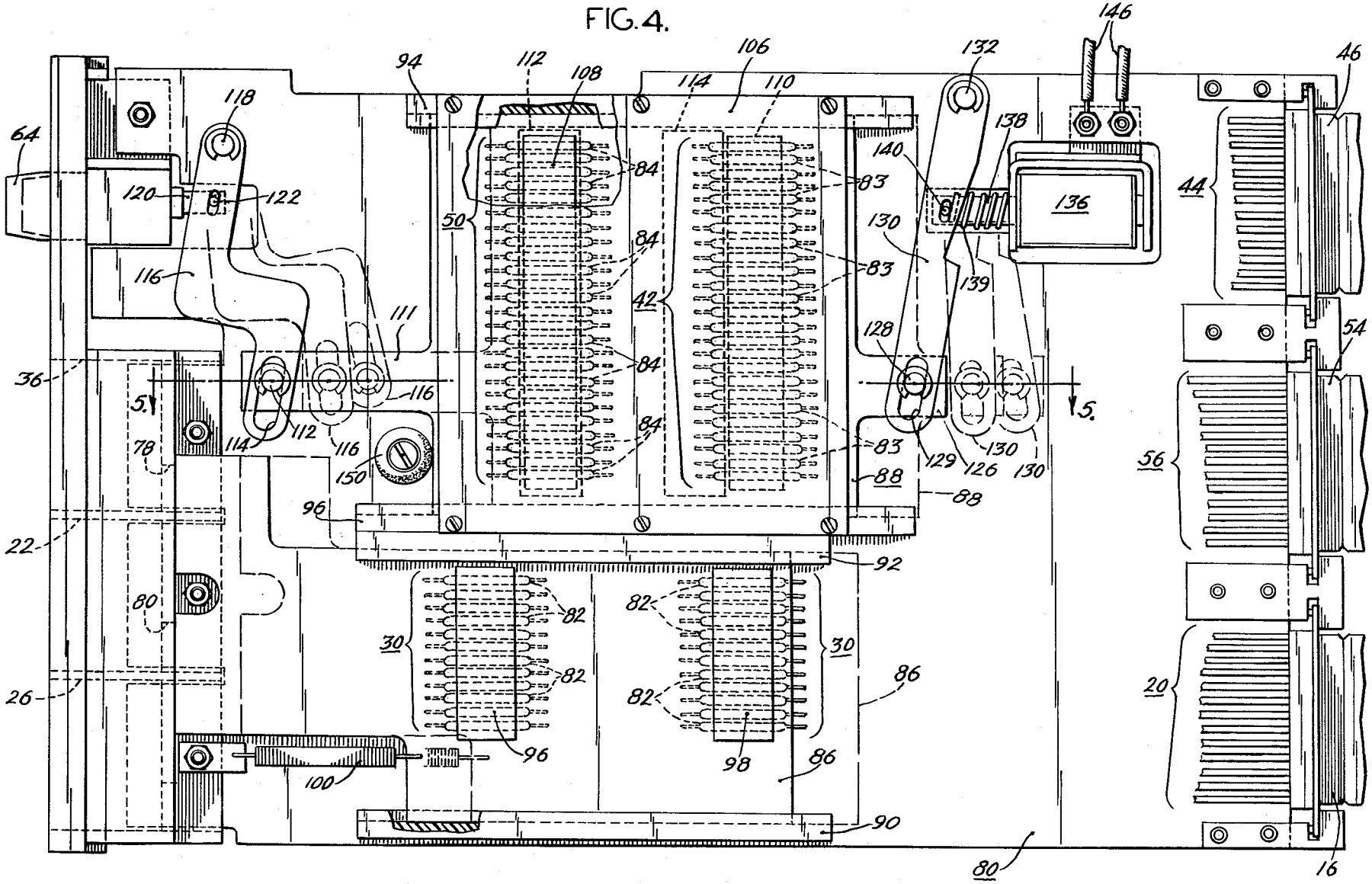
FIG. 4 is a side view, with parts broken away, of the contents of one of the modules of FIG. 2.

In FIG. 4, the apparatus is shown in the "normal" position corresponding to FIG. 5, in which the switch means 42 are exposed to the magnetic field and switch means 50 is shielded from the magnetic field. The arrangement by which the panel 88 is moved from the position of FIG. 5 to the position of FIG. 6 in the present embodiment will now be described.

Panel member 88 is provided with a forwardly-extended ear 111 carrying a pin 112 disposed in the slot 114 of a mechanical-linkage member 116, pivoted at its opposite end about a pivot 118. Mechanical pushbutton device 64 is provided with a rearwardly-extending rod 120 pivotably secured to linkage 116 at 122, so that inward mechanical pressing of pushbutton 64 causes linkage 116 to pivot first to the right-most position shown in dashed line and then to fall back to a stable position, corresponding to the left-most dashed position of linkage 116, where it then remains. Thus pushbutton device 64 in this example is of a well-known, commerically-available latching type which, after a first pressing of the pushbutton causes its rearwardly-extending rod 120 to assume a stable position corresponding to the left-most dashed outline of linkage 116, and upon the next-subsequent pressing of the pushbutton causes rod 120 to move first to the position shown in the right-most dashed outline of linkage 116 and then to resume the stable position corresponding to the solid line for linkage 116. The solidline stable position of linkage 116 caused panel 88 to assume the position shown in FIG. 5, while the stable position shown by the left-most dashed outline of linkage 116 causes panel 88 to assume the position shown in FIG. 6.

At the opposite or rearmost side of panel 88 there is provided another ear 126 carrying a pin 128 which extends through a slot 129 in a linkage 130, pivoted at its opposite end about a pivot 132 on the main support panel. A solenoid device 136 is provided with an armature 138 secured to a pivot pin 140 on linkage 130, whereby reciprocating motion of armature 138 due to current through the solenoid coil causes linkage 130 to move from the stable position shown in full line to the stable vertical position shown in dotted line in FIG. 4. During such switching of stable positions, the linkage 130 will momentarily assume the right-most position shown in broken outline in FIG. 4, in response to application of current to solenoid 136 from wires 146, but the linkage 130 will assume the stable state shown by the vertical, broken-line position of linkage 130 when the current to the solenoid coil is terminated.

While the solenoid 136 does not in itself provide the above-described bistable latching action, since linkage 130 is coupled through the panel 88 to the linkage 116, which is in turn coupled to the output rod 120 of the double-latching pushbutton switch 64, the latching of the panel position into its two stable states will occur as described in response to solenoid operation. It will be understood that the solenoid arrangement and the mechanical pushbutton arrangement are both such that each accommodates actuation of the panel 88 by the other. A suitable stop member 150 may be provided on the main support panel accurately to determine the forwardmost position of the panel 88.

The current to the solenoid lead wires 146 is supplied by the previously described momentary-make pushbutton switch 68 of FIGS. 1 and 2, and it will be seen that this switch need be held closed only long enough for the panel 88 to move to the desired latch position; upon the next subsequent momentary actuation of switch 68, the solenoid will again pull the linkage 130 to its extreme right-ward position, thus actuating the mechanical latching pushbutton device 64 through panel 88, to release the pre-existing latch condition and permit the linkage 130 to return to its left-most position.

Accordingly, any momentary pressing of the pushbutton device 64 will cause the switch means 42 and 50 to reverse their electrical states, as will any momentary pressing of the electrical control switch 68. Thus the condition of the switches 42 and 50, and the connection into the system of local equipment or local equipment B, can be controlled at will either by the mechanical pushbutton on the front of the module or by the electrical switch, which may be remotely located but, as will be shown hereinafter, can also be placed on the front of the module if desired.

In this embodiment a spring member 139 is preferably provided around the armature 138, acting to urge the linkage 130 to its left-most position; while the commercially-available form of pushbutton member 64 normally includes a spring tending to bias its rod 120 to its left-most position and hence tending to bias the panel member 88 to its left-most position, the use of the additional spring 139 has been found useful in some cases.

Figure 8:
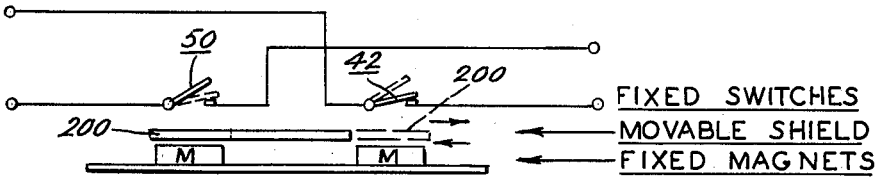
FIGS. 8 and 9 are schematic diagrams illustrating two different modifications of the apparatus of FIG. 4.

FIG. 8 illustrates schematically a modification of the arrangement of FIGS. 4–7, in which there is employed a single movable shield 200, rather than two separate shields, the length of the shield 200 along the direction of travel its motion being such that, in the position shown in full line, the switch means 50 is shielded and the switch means 42 is unshielded from their corresponding permanent magnets M, while when the shield is moved to the right so that the magnetc shield assumes the terminal position shown in dotted line in FIG. 8, switch means 50 will no longer be shielded but switch means 42 will be shielded, thereby to accomplish the desired reversal of the state to the two switch means.

Figure 9:
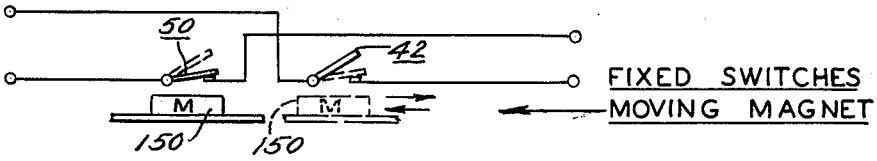

FIG. 9 illustrates schematically a variation of the arrangement of FIG. 4 wherein a single permanent magnet 150 is moved from alignment with switch means 50 as shown in full line, into alignment with switch means 42 as shown in dotted outline, thereby to accomplish the desired reversal states of the two switch means.

The foregoing combinations of switch means, permanent magnets, shielding members, and arrangements for moving various combinations of the elements with respect to each other may obviously take many different forms, there being however in each case a movable member which changes the exposure of a switch means to a magnetic switch-actuating field.

Figure 10:
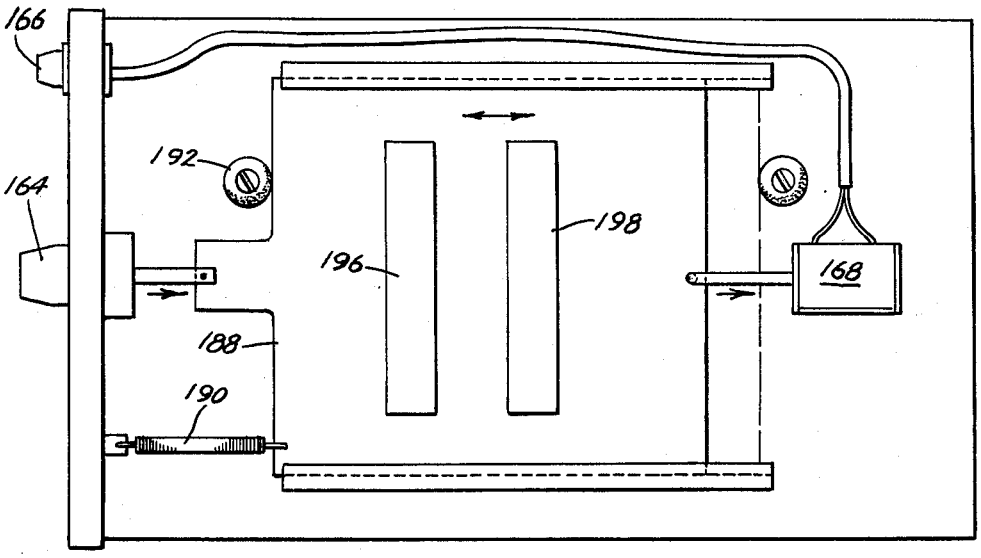
FIG. 10 is a somewhat diagrammatic side view of still another modification of the apparatus of FIG. 4.

FIG. 10 shows, in somewhat schematic form, another arrangement for the interior of a module according to the invention. In this arrangement the panel 188 is spring-biased forwardly by a spring 190 against a stop 192, and can be moved to an alternate rearward position against the force of the spring, either by operating the mechanical pushbutton actuator 164 inwardly, or by operating the electrical switch 166 located in the front of the module, thereby to operate the solenoid device 168 and move panel 188 in the rearward direction against the spring. The two magnets 196 and 198 carried by the panel 188 may be positioned so that, in the normal forward position of the panel, one of the magnets is aligned with its corresponding switch means while the other is not; when either the mechanical actuator 164 or the electrical switch 166 is operated, the panel and magnets will be moved to the position for which the relation of the permanent magnets to their corresponding switch means is reversed, thereby to reverse the states of the corresponding switch means.

One may, of course, employ even more magnets, or more shielding members, and the array of switches may sometimes be made movable. If desired, the portions of a magnetic-shield supporting panel which are not aligned with a magnetic shielding member may be removed to provide windows and thus lighten the weight of the panel, and in fact the magnetic panel may be made entirely of appropriate magnetic shielding material, except for windows cut in it where shielding is not desired. Further, the latching mechanism and/or the spring return, when used, need not be part of the pushbutton mechanism, but may be located elsewhere. Many such variations and combinations will be apprent to one skilled in the art.

It is also contemplated that in some instances, as has been found useful, the mechanical actuation of the panel-motion producing switch operation may be dispensed with, and only the electrical control of switch position used, which is often advantageous because of the great flexibility of position, control, and selection of particular modules for control which can be accomplished by appropriate electrical interconnections even if no mechanical actuation is utilized. In such cases one may also use two solenoids operating in opposite direction, rather than one, with a suitable detent to hold the magnet carrier or shield in one of its positions, or in both positions. It is also possible to accomplish the latching functions in the electrical circuitry, rather than in the mechanical construction.

Accordingly, while the invention has been particularly described with reference to specific embodiments in the interest of complete definiteness, it will be understood that it may be embodied in a wide variety of forms, diverse from those specifically shown and described, without departing from the spirit and scope of the invention as defined by the appended claims.

What is claimed is:

1. Electrical switching apparatus, comprising:
a plurality of magnetically-actuatable switch means;
magnet means positioned adjacent said switch means;
electromechanical means responsive to changes in an electrical quantity for controlling the effect of said magnet means upon said switch means to accomplish actuation of said switch means from a first electrical state thereto to a second electrical state thereof; and
manually-operable mechanical means for also controlling the effect of said magnet means upon said switch means, alternatively to control said actuation of said switch means.

2. The apparatus of claim 1, wherein said switch means comprise a plurality of magnetically-actuatable switches.

3. The apparatus of claim 1, wherein said switch means are reed switches.

4. The apparatus of claim 1, wherein said magnet means comprise at least one permanent magnet.

5. The apparatus of claim 1 comprising a frame on which said switch means are mounted, said magnet means being movable with respect to said switch means in response to either of said electromechanical means or said mechanical means to effect said actuation of said switch means.

6. The apparatus of claim 5, comprising magnet support means supporting said magnet means, said magnet support means being movable by either of said electromechanical means and said manually-operable mechanical means to provide said controlled actuation of said swtich means.

7. The apparatus of claim 6, wherein said magnet support means is slidable with respect to said frame.

8. The apparatus of claim 1 wherein said electromechanical means comprises a solenoid device having an armature movable in response to electrical signals.

9. The apparatus of claim 8 comprising linkage means connected to said armature for moving said magnet means in at least one direction in response to motion of said armature.

10. The apparatus of claim 1, wherein said electromechanical means responsive to changes in an electrical quantity for controlling the effect of said magnet means upon said switch means comprises magnetic shield means movable with respect to said magnet means for controlling said effect of said magnet means.

11. The apparatus of claim 10, wherein said magnetic shield means is slidable with respect to said magnet means in response to either of said electromechanical means or said mechanical means.

12. The apparatus of claim 11, wherein said mechanical means comprises a mechanical pushbutton device having an output member for mechanically moving said magnetic shield means in response to operation of said pushbutton device.

13. The apparatus of claim 12, wherein said electromechanical means comprises solenoid means having a mechanical output member for moving said magnetic shield means, and current control means positioned remote from said solenoid means for controlling its operation.

14. Electrical switching apparatus, comprising:
a plurality of adjacent magnetically-operable switches;
magnet support means slidably mounted adjacent said switches, and permanent magnet means supported on said support means, said support means being slidable between a first position in which said magnet means causes said switch means to assume one set of electrical states and a second position in which said switches assume another set of electrical states;
electromechanical means responsive to remotely-applied electrical signals to control motion of said support means between said first and second positions; and
manually-operable mechanical means for providing alternative control of said motion of said support means between said first and second positions.

15. The apparatus of claim 14, comprising mechanical latching means for holding said support means in at least one of said positions when said mechanical means is not being manually operated.

16. The apparatus of claim 15, comprising spring means for biasing said support means toward one of said positions thereof.

17. Electrical switching apparatus, comprising:
a plurality of adjacent magnetically-operable switches;
permanent magnet means positioned adjacent said switches;
magnetic shield means positioned between said magnet means and said switches, said shield means being movable between a first position in which said magnet means causes said switch means to assume one set of electrical states and a second position in which said switches assume another set of electrical states;

electromechanical means responsive to remotely-applied electrical signals to control motion of said shield means between said first and second positions; and manually-operable mechanical means for providing alternative control of said motion of said shield means between said first and second positions.

18. The apparatus of claim 17, comprising mechanical latching means for holding said shield means in at least one of said positions when said mechanical means is not being manually operated.

19. The apparatus of claim 17, comprising spring means for biasing said shield means toward one of said positions thereof.

* * * * *